US005936535A

United States Patent [19]

Rosen et al.

[11] Patent Number: 5,936,535

[45] Date of Patent: Aug. 10, 1999

[54] CIRCUIT BREAKER BELL ALARM ACCESSORY

[75] Inventors: James L. Rosen, West Hartford; Dean A. Robarge, Southington, both of Conn.

[73] Assignee: General Electric Company, Schenectady, N.Y.

[21] Appl. No.: 09/087,542

[22] Filed: May 29, 1998

[51] Int. Cl.[6] ..... G08B 21/00

[52] U.S. Cl. ..... 340/638; 335/17; 335/172

[58] Field of Search ..... 340/638, 644; 335/17, 172, 14; 200/401, 400

[56] References Cited

U.S. PATENT DOCUMENTS

| | | | |
|---|---|---|---|
| 5,453,724 | 9/1995 | Seymour et al. | 335/172 |
| 5,502,286 | 3/1996 | Pollman et al. | 200/401 |
| 5,701,110 | 12/1997 | Scheel et al. | 335/132 |

*Primary Examiner*—Jeffery A. Hofsass

*Assistant Examiner*—Sihong Huang

*Attorney, Agent, or Firm*—Cantor Colburn LLP; Carl B. Horton

[57] ABSTRACT

An air circuit breaker bell alarm accessory interacts with the circuit breaker operating mechanism to provide local target indication as well as remote signal indication of the separation of the circuit breaker contacts. An indicator switch provides remote signal indication while a lock-out switch interacts with the accessory target to prevent re-closure of the circuit breaker contacts. One of the switches is selected having "normally open" contacts while the other switch is selected having "normally closed" contacts to reduce the amount of mechanical force required to simultaneously operate the indicator and lock-out switches.

28 Claims, 5 Drawing Sheets

(NON-TRIPPED)

(NON-TRIPPED)

(TRIPPED)

CIRCUIT BREAKER BELL ALARM ACCESSORY

BACKGROUND OF THE INVENTION

Air circuit breakers as described within U.S. Pat. Nos. 3,095,489 entitled "Manual Charging Means for Stored Energy Closing Mechanisms of Electric Circuit Breakers" and 3,084,238 entitled "Ratchet Mechanism for Charging a Closing Spring in an Electric Circuit Breaker" include operating mechanisms that are mainly exposed to the environment. Since the air circuit breakers are rated to carry several thousand amperes of current continuously, the exposure to convection cooling air assists in keeping the operating components within reasonable temperature limits.

Various accessory devices are used with such air circuit breakers to provide auxiliary function along with overcurrent protection. One such accessory is the bell alarm accessory that provides local and remote indication as to the occurrence of circuit interruption. U.S. Pat. No. 5,502,286 entitled "Bell Alarm and Lock-Out for High Ampere-Rated Circuit Breakers" describes a bell alarm accessory used with so-called "insulated case" circuit breakers wherein the circuit breaker interrupting components are completely enclosed within an insulating plastic enclosure. This patent describes one such bell alarm accessory that interacts with the circuit breaker operating mechanism to activate the bell alarm upon circuit interruption and to lock-out or prevent the closing of the circuit breaker contacts until the accessory is manually reset.

U.S. patent application Ser. No. 08/875,595 filed on 19 Jun. 1997 entitled "Circuit Breaker Bell Alarm Accessory with Lock-out" provides a bell alarm accessory that provides local as well as remote indication of such circuit interruption as well as preventing circuit breaker contact closure until and unless the accessory has become manually reset.

High-ampere rated air type circuit breakers operate in the range of 2500 to 5000 amperes such that the large circuit breaker operating components are arranged with the bell alarm reset components in a particular manner. When low-ampere rated air type circuit breakers that operate in the range of 150 to 1500 amperes require bell alarms with automatic lockout function, the arrangement of the circuit breaker operating smaller components do not readily allow the use of the high-ampere rated bell alarm reset accessory due to the lower mechanical forces generated within the lower rated circuit breakers. Especially in view of the requirement of a pair of switches, one for remote indication of the fault occurrence and another to provide the interlock function.

One example of an electric switch mechanism within relays and contactors that includes a slider intermediate a pair of contact springs to enhance operation of the switch mechanism is depicted in U.S. Pat. No. 4,983,788 entitled "Electric Switch Mechanism for Relays and Contactors".

It would be economically advantageous to use a common bell alarm accessory in different ampere-rated air circuit breakers without decreasing the size of the accessory components in accordance with the lower mechanical forces available at the lower ampere ratings.

One purpose of the invention, accordingly, is to describe a bell alarm accessory for common use with small-ampere rated air type circuit breakers of differing ampere ratings that allows automatic remote indication along with lock-out function upon response of the small-ampere rated circuit breaker operating mechanism to separate the circuit breaker contacts.

SUMMARY OF THE INVENTION

An air circuit breaker bell alarm accessory interacts with the circuit breaker operating mechanism to provide local target indication as well as remote signal indication of the separation of the circuit breaker contacts. An indicator switch provides remote signal indication while a lock-out switch interacts with the accessory target to prevent re-closure of the circuit breaker contacts until and unless the bell alarm accessory is reset. One of the switches is selected having "normally open" contacts while the other switch is selected having "normally closed" contacts and the bell alarm accessory is shaped to reduce the amount of mechanical force required to simultaneously operate the indicator and lock-out switches.

DESCRIPTION OF THE PREFERRED EMBODIMENT

Figure 1:
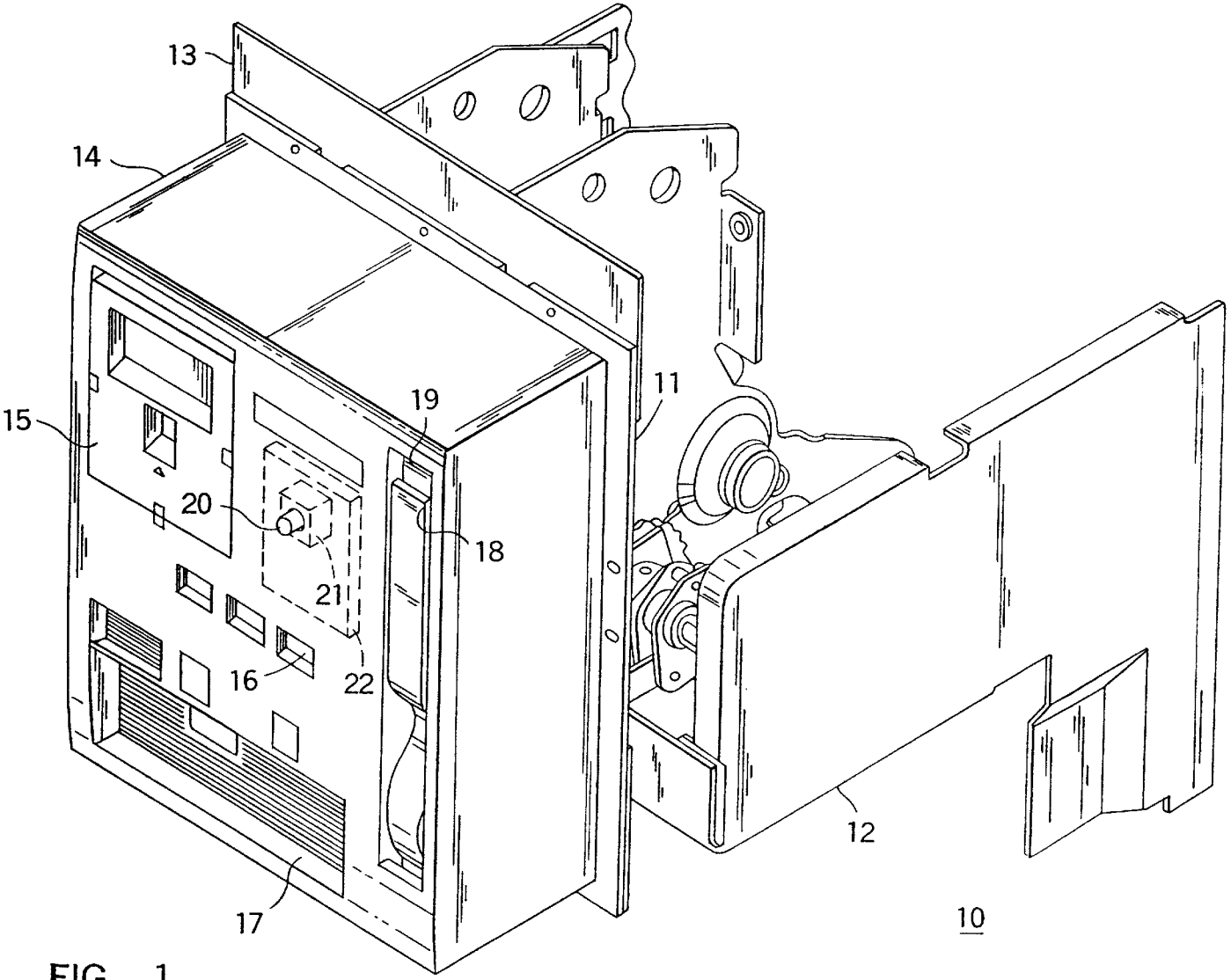
FIG. 1 is top perspective view of an air circuit breaker containing the bell alarm accessory module in accordance with the invention attached to a front part of the circuit breaker contact closing assembly.

The air circuit breaker 10 of FIG. 1 is shown attached to the circuit breaker cover plate 13 interfacing with the circuit breaker contact closing assembly 11 that is positioned between the circuit breaker operating mechanism sideframes 12 similar to that described within the aforementioned U.S. Pat. No. 3,095,489. The circuit breaker cover 14 supports the trip unit programmer 15 which programmer is similar to that described in U.S. Pat. No. 4,672,501 entitled "Circuit Breaker and Protective Relay Unit". The circuit breaker cover includes buttons 16 for releasing the circuit breaker operating mechanism (not shown) circuit breaker contacts (not shown) to their OPEN condition and for moving the contacts to their CLOSED condition. The circuit breaker operating handle 18, positioned within the handle recess 19, allows manual interaction with the contact springs closing mechanism 11 to charge the circuit breaker closing springs allowing the opening and closing of the circuit breaker contacts. An accessory such as a bell alarm module 21, similar to that describes in the aforementioned U.S. Pat. No. 5,502,286 is mounted on a bell alarm reset assembly 22 to provide visual indication of the occurrence of contact separation by means of the pop-up target 20. Other circuit breaker accessories can be inserted within the accessory recess 17, if so desired.

Figure 2:
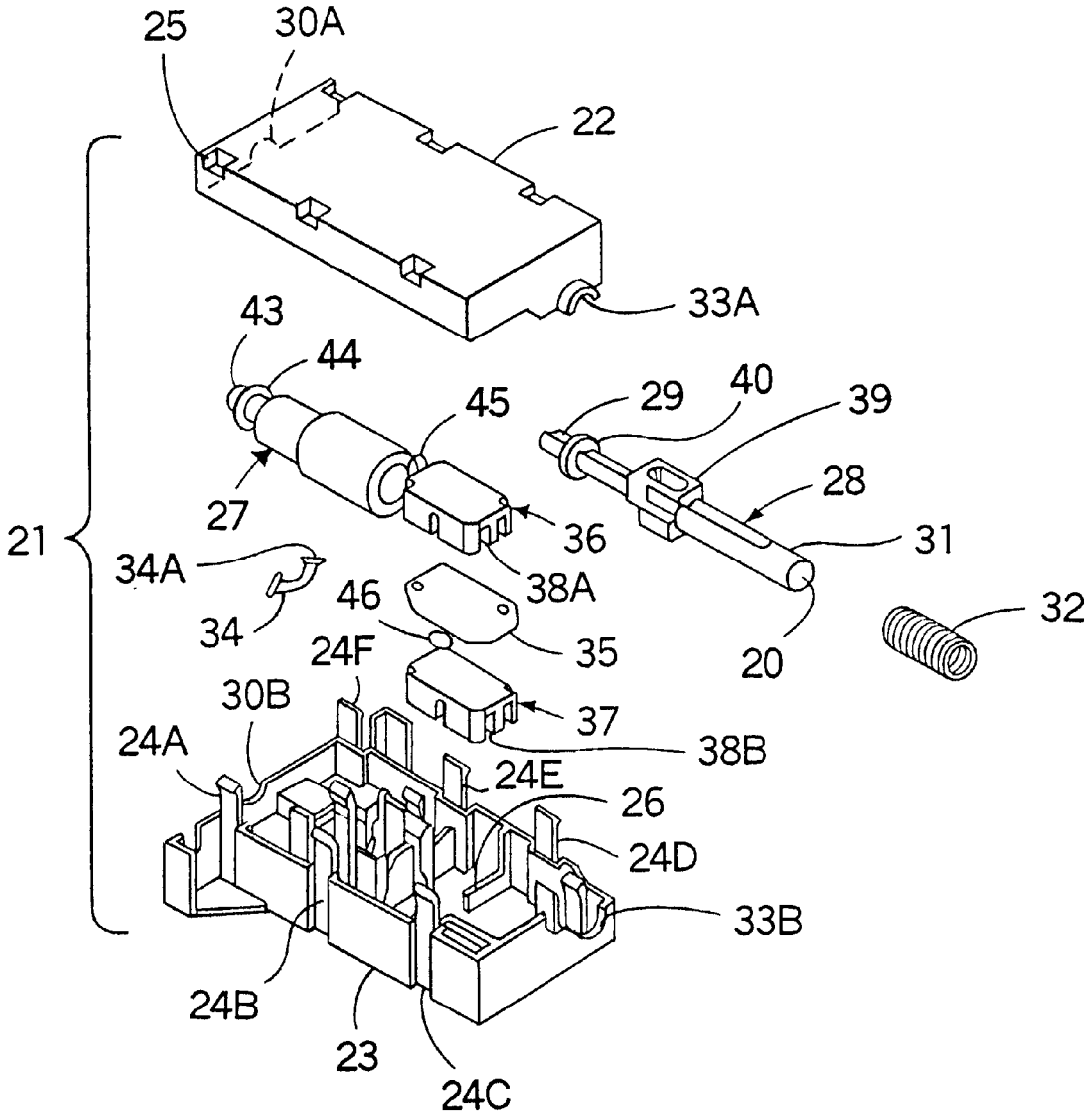
FIG. 2 is an exploded top perspective view of the bell alarm accessory module of FIG. 1 with the components thereof in isometric projection.

In accordance with the invention, a bell alarm module 21 is assembled as shown in FIG. 2 by arranging the flux shifter unit 27, similar to that described in the aforementioned U.S. Pat. No. 5,502,286, within the base 23 by means of small clips 24(A-F) integally-formed therewith and extending in the vertical direction. The base is fabricated from a thermoplastic material such as DELRIN, a trademark of Dupont Co., having good structural and flexural properties. The flux shifter reset stem 43 extends from one end of the module 21 by means of the semicircular lock-out aperture 30A, 30B formed within the cover 22 and base 23, respectively. The target unit 28 is positioned next to the flux shifter unit 27 and includes a target reset stem 29 at one end and an indicating target 20 at an opposite end thereof. A compression spring 32 encompasses the target stem 31 which extends through the opposite end of the module 21 by means of the semicircular reset aperture 33A, 33B formed within the cover 22 and base 23, respectively. The target unit differs from that described within the aforementioned U.S. Pat. No. 5,502,286 by the configuration of the rectangular target unit body 39 which will be described below with reference to FIG. 3. The U-shaped rocker 34 is positioned between the flux shifter unit 27 and the target unit 28 and interacts with the rim 44 on the reset stem 43 by means of end 34A and with the rim 40 on the reset stem so that the translation of the of the flux shifter reset automatically projects the target 20. A first electric switch 36 is positioned next to the target unit 28 and a second electric switch 37 is positioned under the first switch. An insulator plate 35 is positioned between the first and second switches to provide good electrical isolation between the switches and external electrical connection is made with the switches by means of the connectors 38A, 38B respectively. The first and second switches may be any suitable switching device, such as a microswitch. In further accordance with the invention, the first switch is selected as a "normally open" switch and the second switch is selected as a "normally closed" switch such that the switch actuators 45, 46 extending from the first and second switches 36, 37 interact with the rectangular target unit body 39 to facilitate the small size of all the bell alarm module components by facilitation of the force requirements for mechanically opening and closing the switches as best seen by now referring to FIG. 3.

Figure 3:
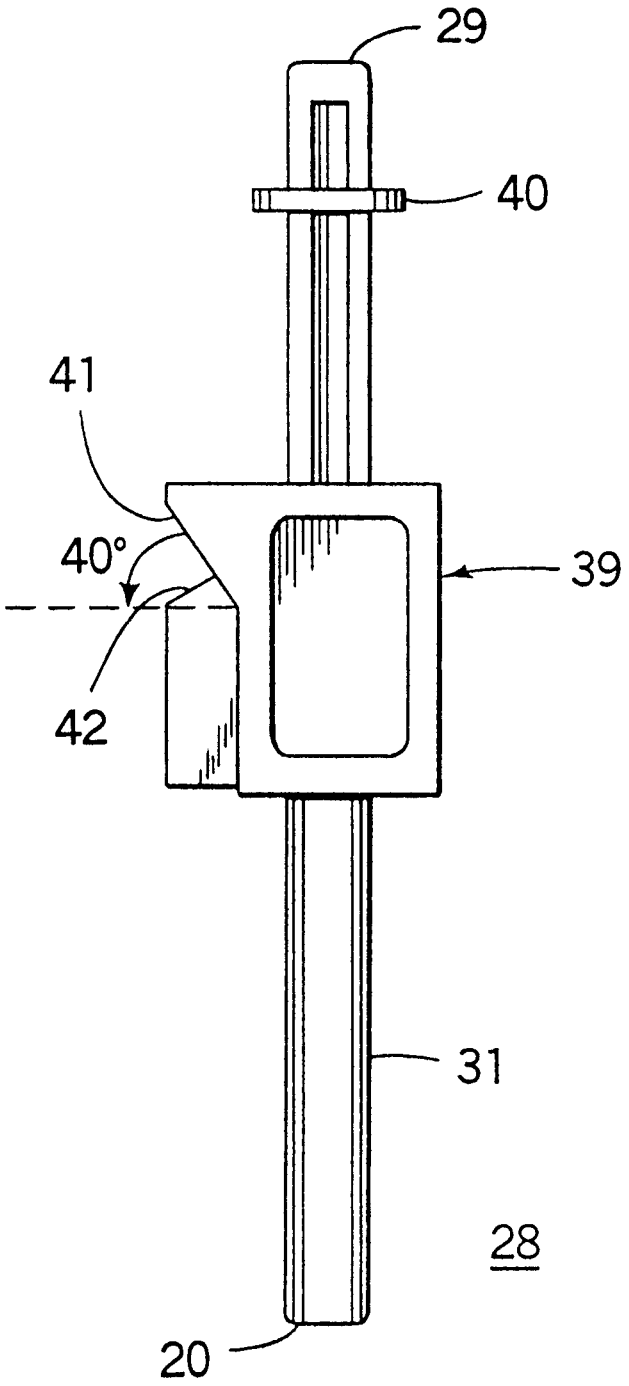
FIG. 3 is an enlarged front perspective view of the bell alarm accessory module contained within the bell alarm unit of FIG. 2.

In FIG. 3, the target unit 28 is shown to include the target stem 31, the target 20 at the end of which extends outside of the bell alarm module 21 of FIG. 1 to give external indication that the flux shifter unit 27 of FIG. 2 has responded to an overcurrent condition within the associated protected circuit. The target reset stem 29 and reset rim 40 interact with the flux shifter unit as described earlier. To provide minimum mechanical force requirements in operation of the switches 36, 37 shown in FIG. 2, the rectangular body 39 is shaped to define a pair of first and second ramps 41, 42 extending in opposite directions such that the ramps form a angle of at least 40° through the plane perpendicular to the linear extent of the target stem 31.

Figure 4:
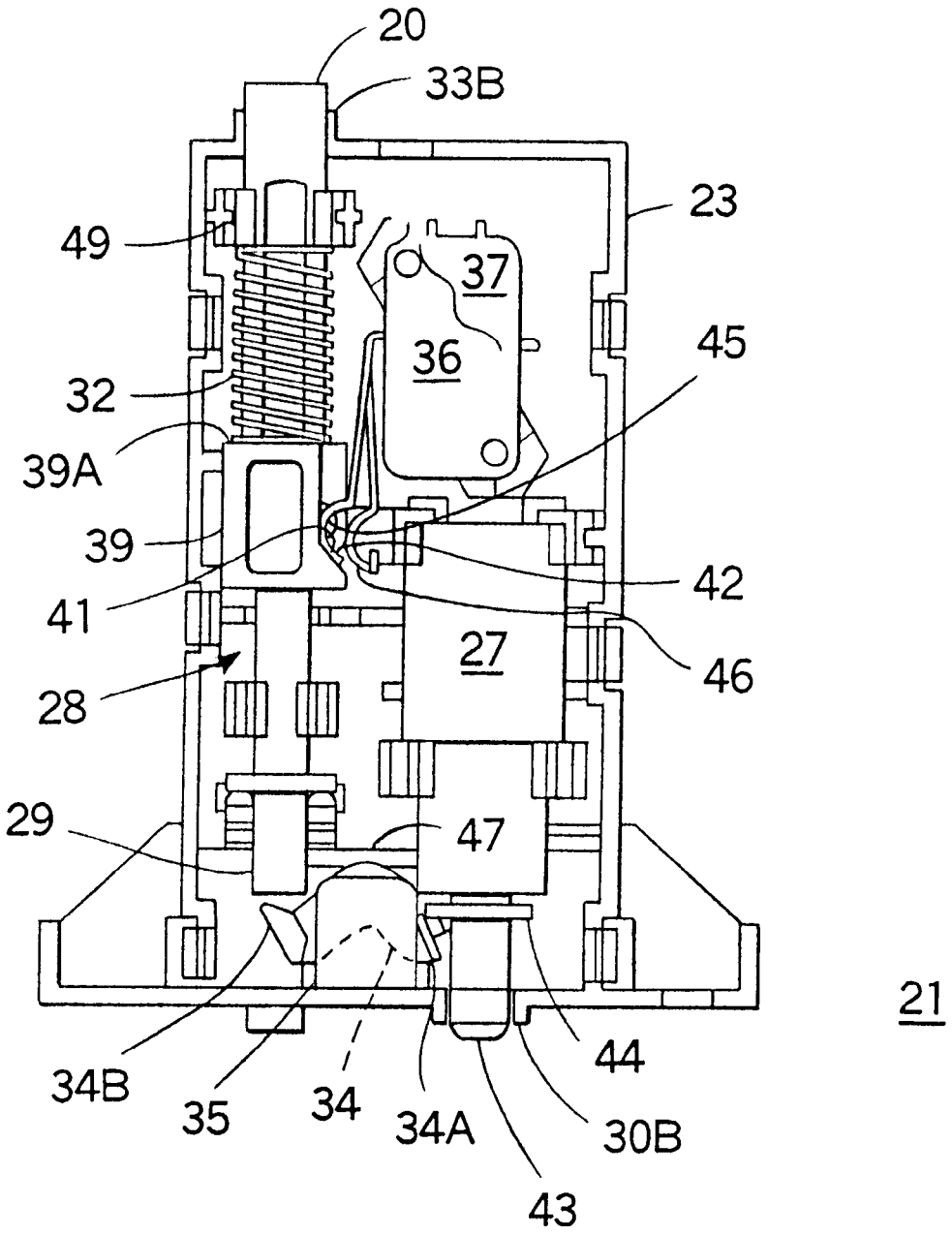
FIG. 4 is an enlarged top plan view of the bell alarm accessory module of FIG. 2 with the circuit breaker contacts in the CLOSED condition.

When the switches 36, 37 are arranged within the base 23 of the bell alarm module 21 as shown in FIG. 4, the actuator 45 of the first switch 36 is positioned at the bottom of the first ramp 41 and the actuator 46 of the second switch 37 is positioned at the top of the second ramp 42. The flux shifter unit 27 is in the reset mode with the reset stem 43 retracted within the semicircular slot 30B and the end 34A of the rocker 34 rests against the reset rim 44 of the flux shifter unit 22. The bell alarm target unit 28 is also in the reset position with the target 20 of the target stem 31 within the semicircular slot 33B and the compression spring 32 is in the uncompressed state against the front edge 39A of the rectangular body 39 of the bell alarm target unit 28. When the first switch 36 is a "normally-closed" switch wherein the first switch contacts (not shown) are together such that when the first actuator unit 45 is actuated the first switch contacts become opened, the second switch 37 is selected as a "normally-open" switch wherein the second switch contacts (not shown) are apart such that when the second actuator unit 46 is actuated, the second switch contacts become closed. This arrangement allows the contact springs (not shown) within the respective switches to oppose each other when the respective first and second actuator units 45, 46 are actuated at the same time. The positioning of the respective first and second actuator units at opposing ends of the first and second ramps 41, 42 as shown in FIG. 3, allows the transfer motion along the ramps to counterbalance the forces of the contact springs so that the resulting force on the target unit 28 is de minimis. The arrangement of the actuator units and ramps is an important feature of the invention since it allows a pair of switches to be actuated without requiring additional force multipliers to be arranged within a standard sized pre-existing bell alarm module unit.

Figure 5:
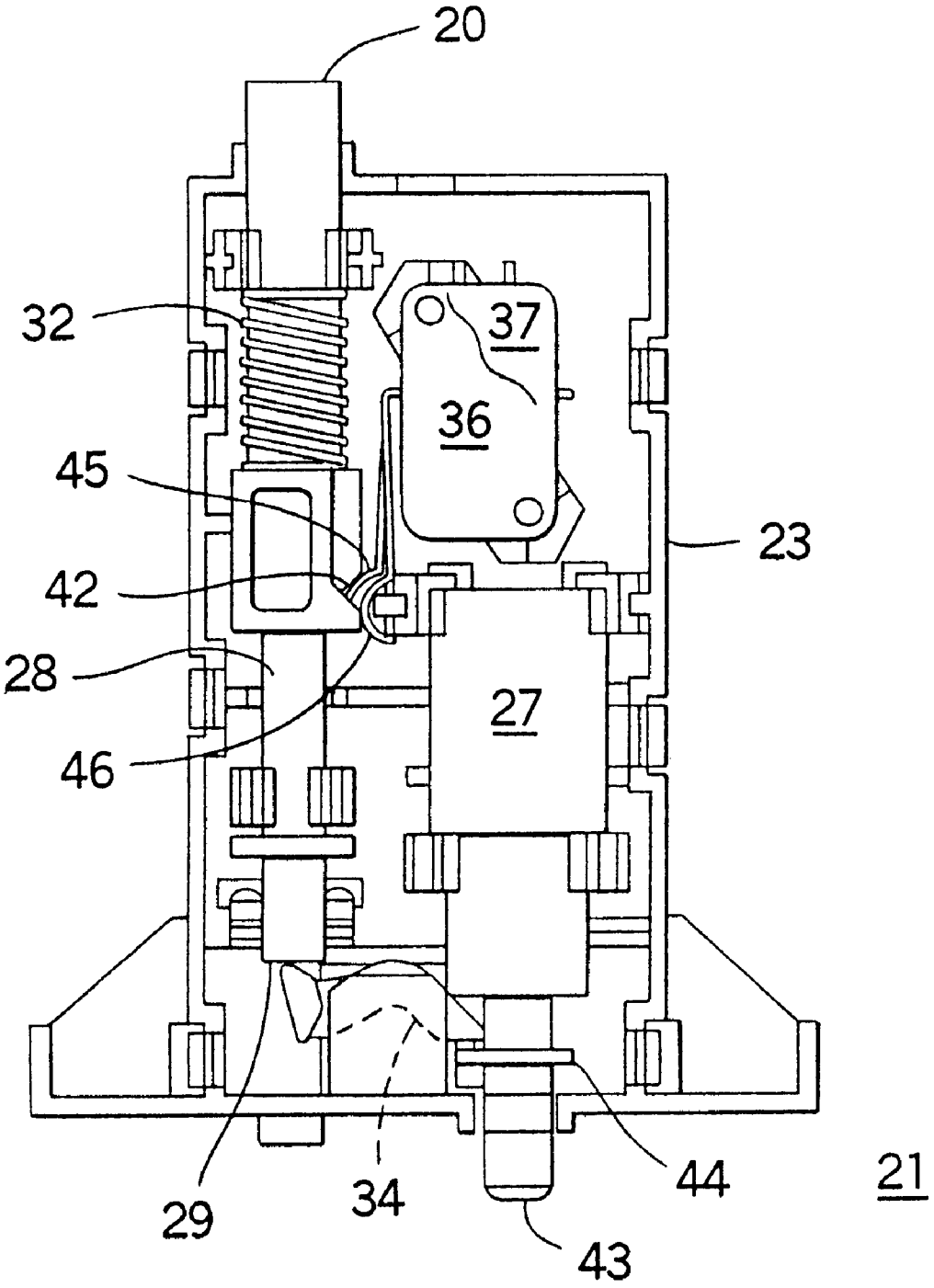
FIG. 5 is an enlarged top plan view of the bell alarm accessory module of FIG. 2 with the circuit breaker contacts in the OPEN condition.

When an electric signal is received from the trip unit programmer 15 of FIG. 1, the bell alarm module 21 assumes the "tripped" condition depicted in FIG. 5 wherein the flux shifter 27 releases the flux shifter reset stem 43, the interaction between the target unit 28 via the rocker 34, as described earlier, drives the target 20 external to the base 23 under the urgence of the charged compression spring 32 to provide visual indication that the circuit breaker contacts have become separated. The spring actuator units 45, 46 move along the respective ramps 41, 42 of FIG. 4 in opposition to the internal contact springs of the first switch 36, and second switch 37 described earlier, with a minimum force generation during contact closure within the first switch and contact separation within the second switch. The flux shifter unit 27 becomes reset by manual displacement of the target 20 which charges the compression spring 32 as the target unit 28 retracts within the base 23 to the reset position shown in FIG. 4, rotating the rocker and resetting the flux shifter unit 27 by virtue of the interaction between the rocker 34 and the flux shifter reset rim 44 in the opposite direction from that described earlier with reference to FIG. 4.

A bell alarm accessory module employing a pair of internal switches for remote signal operation as well as interlock function has herein been described. The selection of one "normally open" switch and one "normally closed" switch and positioning the switch actuators at opposite ends of reverse sloping ramps allows a single bell alarm module design to be used over a wide range of circuit breaker ampere ratings.

What is claimed is:

1. A bell alarm accessory unit comprising:

a base;

a flux shifter unit within said base, said flux shifter being electrically connected with a protected circuit for providing indication of a trip occurrence within said protected circuit;

a target unit within said base proximate said flux shifter unit, said target unit defining a target reset stem at one end and a pop-up target unit at an opposite end thereof, said target unit further including a target body intermediate said target reset stem and said target pop-up unit;

a first electric switch within said base having a first switch actuator extending from said first switch in contact with said target body for actuating said first electric switch upon operation of said flux shifter unit; and a second electric switch within said base having a second switch actuator extending from said second switch in contact with said target body for deactuating said second switch upon operation of said flux shifter unit.

2. The bell alarm accessory unit of claim 1 including a rocker assembly within said base, intermediate said flux shifter unit and said target unit, said rocker assembly operating to retract said target pop-up unit upon reset of said flux shifter unit.

3. The bell alarm accessory unit of claim 2 wherein said flux shifter unit includes a flux shifter reset stem and a flux shifter reset rim arranged on said flux shifter reset stem, said flux shifter reset rim arranged for receiving one end of said rocker assembly and said target reset stem includes a target reset rim arranged for receiving an opposite end of said rocker assembly whereby said flux shifter reset stem and said target reset stem move in opposite directions.

4. The bell alarm accessory unit of claim 1 further including a first ramp formed on a first part of said target body, said first ramp retaining an end of said first switch actuator whereby said first switch actuator moves along said first ramp in cam-follower fashion.

5. The bell alarm accessory unit of claim 4 further including a second ramp formed on a second part of said target body, said second ramp retaining an end of said second switch actuator whereby said second switch actuator moves along said second ramp in cam-follower fashion.

6. The bell alarm accessory unit of claim 5 wherein said first ramp and said second ramp slant in opposite directions.

7. The bell alarm accessory unit of claim 6 wherein said first ramp and said second ramp define an angle of at least 40° relative to a plane defined by said target reset stem.

8. The bell alarm accessory unit of claim 1 including a compression spring arranged about said target unit for returning said target pop-up unit to a non-extended position.

9. The bell alarm accessory unit of claim 1 wherein said first switch comprises a normally open switch and said second switch comprises a normally closed switch.

10. The bell alarm accessory unit of claim 1 wherein said first switch comprises a normally closed switch and said second switch comprises a normally open switch.

11. The bell alarm accessory unit of claim 1 further including:

said base having a base reset aperture arranged at one end and a base lock-out aperture on an opposite end thereof; and a cover having a cover reset aperture arranged at one end and a cover lock-out aperture on an opposite end thereof, said base reset aperture and said cover reset aperture defining a reset aperture, and said base lock-out aperture and said cover lock-out aperture defining a lock-out aperture.

12. The bell alarm accessory unit of claim 11 wherein said base comprises a slot and said cover comprises a clip for attaching to said slot.

13. The bell alarm accessory unit of claim 1 wherein said first and second switches comprise microswitches.

14. A circuit breaker comprising:

an enclosure;

a pair of separable contacts opening in response to a trip occurrence; and a bell alarm accessory including, a base, a flux shifter unit within said base, said flux shifter being electrically connected with a protected circuit for providing indication of said trip occurrence within said protected circuit, a target unit within said base proximate said flux shifter unit, said target unit defining a target reset stem at one end and a pop-up target unit at an opposite end thereof, said target unit further including a target body intermediate said target reset stem and said target pop-up unit, a first electric switch within said base having a first switch actuator extending from said first switch in contact with said target body for actuating said first electric switch upon operation of said flux shifter unit, and a second electric switch within said base having a second switch actuator extending from said second switch in contact with said target body for deactuating said second switch upon operation of said flux shifter unit.

15. The circuit breaker of claim 14 including a rocker assembly within said base, intermediate said flux shifter unit and said target unit, said rocker assembly operating to retract said target pop-up unit upon reset of said shifter unit.

16. The circuit breaker of claim 15 wherein said flux shifter unit includes a flux shift reset stem and a flux shifter reset rim arranged thereon, said flux shifter reset rim arranged for receiving one end of said rocker assembly and said target reset stem includes a target reset rim arranged for receiving opposite end of said rocker assembly whereby said flux shifter reset stem and said target reset stem move in opposite directions.

17. The circuit breaker of claim 14 further including a first ramp formed on a first part of said target body, said first ramp retaining an end of said first switch actuator whereby said first switch actuator moves along said first ramp in cam-follower fashion.

18. The circuit breaker of claim 17 further including a second ramp formed on a second part of said target body, said second ramp retaining an end of said second switch actuator whereby said second switch actuator moves along said second ramp in cam-follower fashion.

19. The circuit breaker of claim 18 wherein said first ramp and said second ramp slant in opposite directions.

20. The circuit breaker of claim 19 wherein said first ramp and said second ramp define an angle of at least 40° relative to a plane defined by said target reset stem.

21. The circuit breaker of claim 14 including a compression spring arranged about said target unit for returning said target pop-up unit to a non-extended position.

22. The circuit breaker of claim 14 wherein said first switch comprises a normally open switch and said second switch comprises a normally closed switch.

23. The circuit breaker of claim 14 wherein said first switch comprises a normally closed switch and said second switch comprises a normally open switch.

24. The circuit breaker of claim 14 wherein said first and second switches compose microswitches.

25. The circuit breaker of claim 14 including:

said base having a base reset aperture arranged at one end and a base lock-out aperture on an opposite end thereof; and a cover having a cover reset aperture arranged at one end and a cover lock-out aperture on an opposite end thereof, said base reset aperture and said cover reset aperture defining a reset aperture, and said base lock-out aperture and said cover lock-out aperture defining a lock-out aperture.

26. The circuit breaker of claim 25 wherein said base comprises a slot and said cover comprises a clip.

27. The circuit breaker of claim 25 whereby depression of said pop-up target causes said flux shifter unit to retract from within said lock-out aperture.

28. The circuit breaker of claim 14 wherein said circuit breaker is an air circuit breaker.

* * * * *